US005701773A

United States Patent [19]

Markisello

[11] Patent Number: 5,701,773

[45] Date of Patent: Dec. 30, 1997

[54] DUAL FUNCTION APPARATUS FOR OPENING AND REMOVING AUTOMOTIVE SIDE-BAR IGNITION LOCKS

[76] Inventor: Frank Markisello, 91-10 Liberty Ave., Ozone Park, N.Y. 11417

[21] Appl. No.: 592,892

[22] Filed: Jan. 29, 1996

[51] Int. Cl.[6] ..... E05B 19/20

[52] U.S. Cl. ..... 70/465; 70/252; 70/368; 70/371; 70/394; 70/465; 29/426.4; 29/426.5; 408/72 B; 408/155 B

[58] Field of Search ..... 70/394, 368, 404, 70/422, 465, 495, 466, DIG. 7, 496, 371, 252; 81/53.2, 181; 29/426.1, 426.4; 33/539, 540; 408/72 B, 97, 115 R, 155 B, 241 B, 202, 241 S

[56] References Cited

U.S. PATENT DOCUMENTS

| | | | |
|---|---|---|---|
| 1,300,275 | 4/1919 | Johnson . | |
| 2,007,143 | 7/1935 | Keil . | |
| 2,906,148 | 9/1959 | Mikeska | 70/466 |
| 4,074,548 | 2/1978 | Milton | 70/422 |
| 4,261,093 | 4/1981 | Steffen et al. | 29/426.4 |
| 4,307,983 | 12/1981 | Blough et al. | 29/426.4 |
| 4,586,233 | 5/1986 | Markisello | 70/417 |
| 4,662,201 | 5/1987 | Phillips | 70/465 |
| 4,671,141 | 6/1987 | Hanson | 81/53.2 |
| 4,682,398 | 7/1987 | Markisello | 70/417 |
| 4,714,386 | 12/1987 | Phillips | 70/465 |
| 4,865,493 | 9/1989 | Miller | 70/465 |
| 5,325,691 | 7/1994 | Embry | 70/394 |
| 5,402,661 | 4/1995 | Markisello | 70/394 |
| 5,454,245 | 10/1995 | Markisello | 70/465 |

*Primary Examiner*—Darnell M. Boucher
*Attorney, Agent, or Firm*—Nathaniel Altman

[57] ABSTRACT

Apparatus for opening, or removing without damage, automotive side-bar type ignition locks, comprises a combination tool with a plurality of projections extending horizontally and forwardly from the combination tool to engage the lock's keyway, at least one balanced pair of recesses in the lock's face, or, optionally, when the tool is used as a lock-remover, the inner walls of the lock's hollow wing-nut cylinder cap. When used as a lock-forcing opener, the combination tool is placed in position on the lock cylinder's face and a conventional wrench gripping the tool's hexagonally-shaped portion is turned to create torque applied by the tool's projections against the walls of the lock's recesses, forcing the lock cylinder to turn to its ON position and start the vehicle's engine. When the lock is to be removed without damage, the combination tool is used as a drill guide mounted on the lock by its projections, with its drill guide hole so positioned that an access hole drilled therethrough gives access for a side-bar pressure tool to be inserted and to exert inward pressure on the lock's side-bar, while at the same time a wafer pressure tool is reciprocated in the lock's keyway to urge the lock's wafer elements into lock-opening alignment, allowing the side-bar to be retracted. The lock can then be removed from its automotive mounting, a replacement key made, and the lock returned and reinstalled for continued use. Combination tool, matching drill bit, side-bar pressure tool and wafer pressure tool may be provided as a locksmith's kit.

9 Claims, 2 Drawing Sheets

FIG. 1
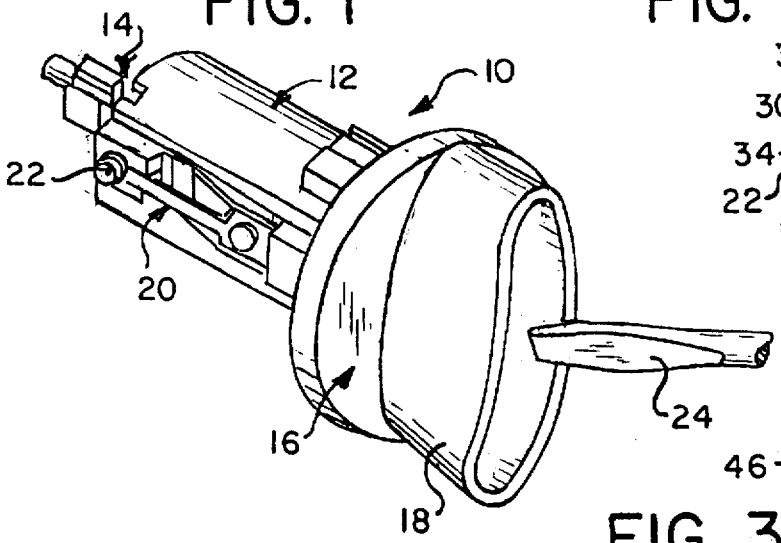
FIG. 2
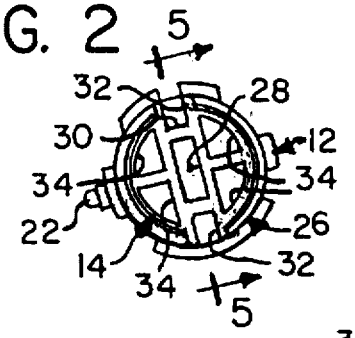
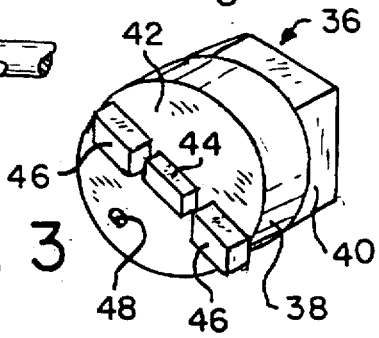
FIG. 3
FIG. 4
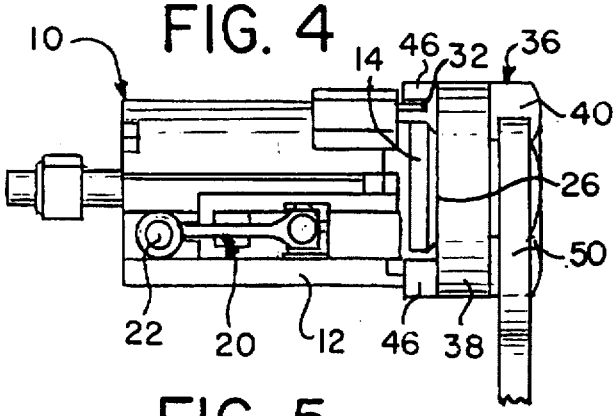
FIG. 6
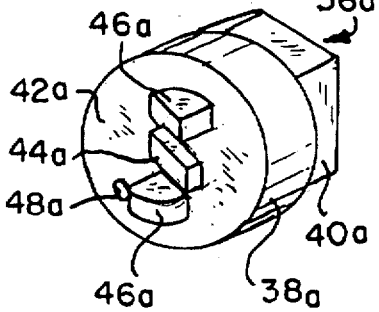
FIG. 5
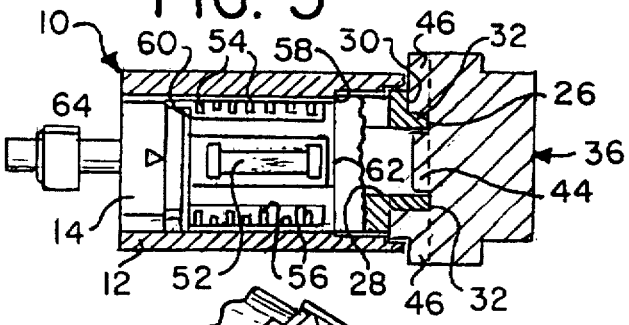
FIG. 7
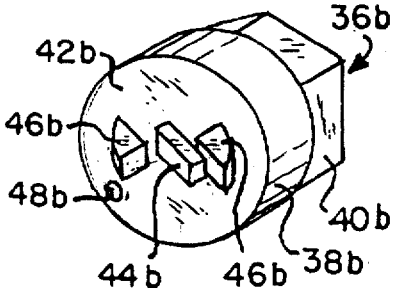
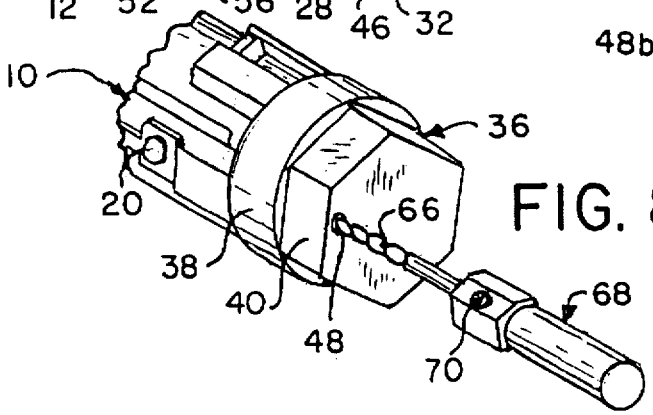
FIG. 8

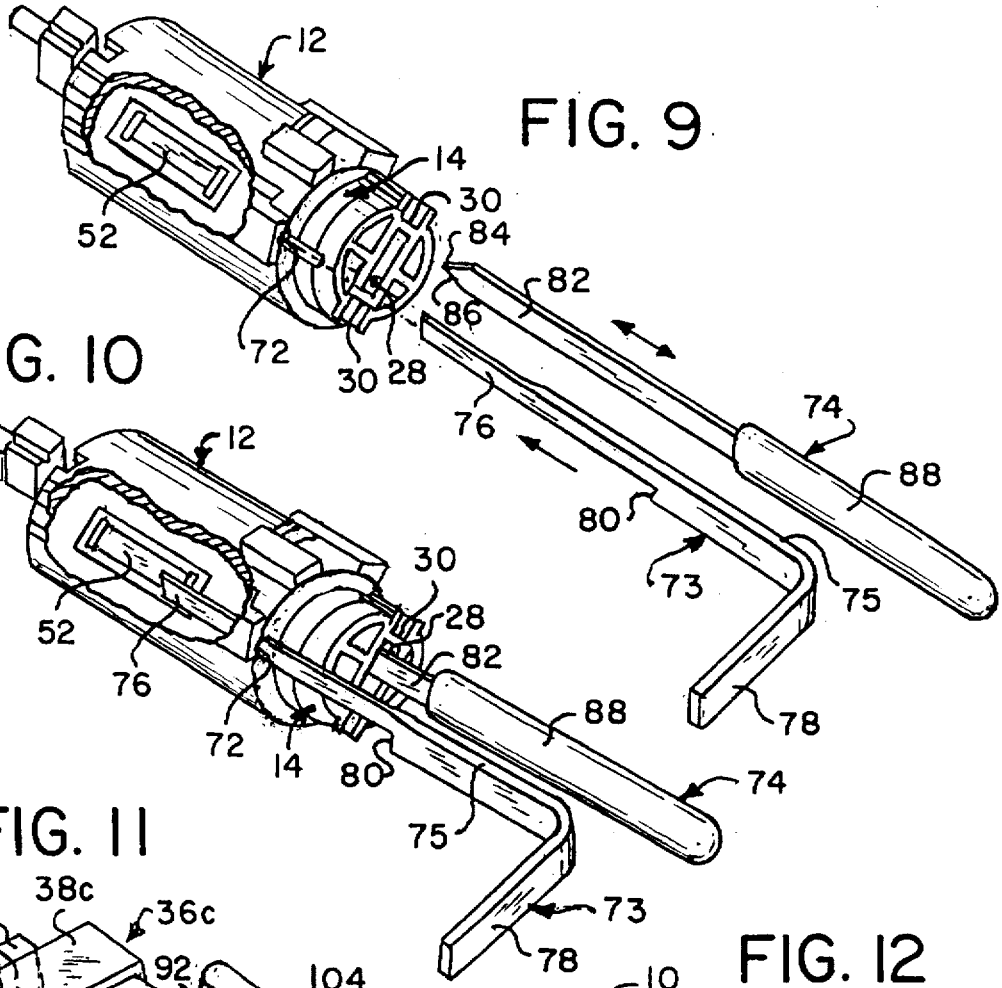
FIG. 9
FIG. 10
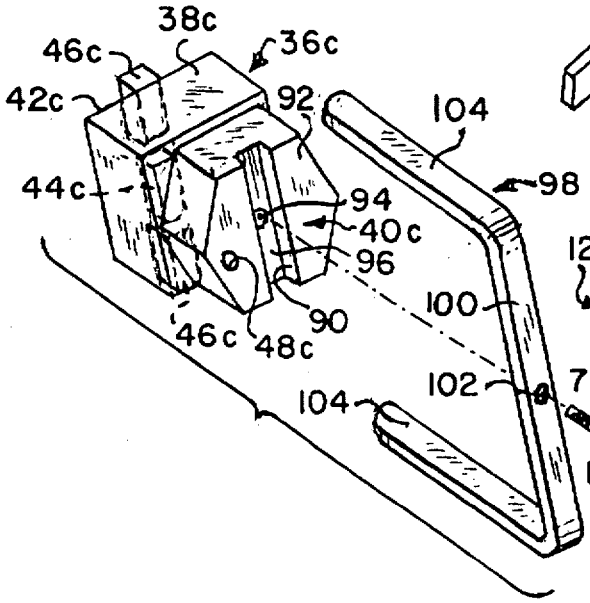
FIG. 11
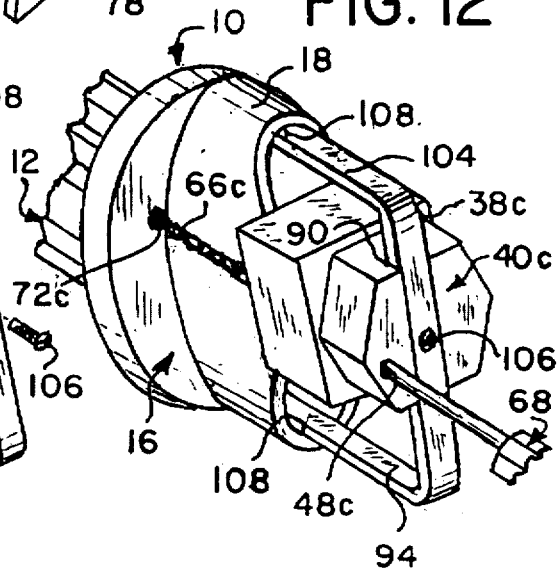
FIG. 12

DUAL FUNCTION APPARATUS FOR OPENING AND REMOVING AUTOMOTIVE SIDE-BAR IGNITION LOCKS

FIELD OF THE INVENTION

This invention is concerned with automotive side-bar ignition locks and apparatus for opening them and/or removing them without damage in the absence of a key.

BACKGROUND OF THE INVENTION

Developments and improvements in automotive side-bar ignition locks have made them more secure and less subject to unlawful tampering or "picking". As a consequence, current ignition lock designs confront the locksmith, no key being available, with the decision whether to turn the ignition on without delay, when the situation warrants, as when the vehicle must be moved promptly, at the expense of a lock cylinder replacement, or to remove the lock cylinder without damage so that a key may be made and the original cylinder then reinstalled for continued use.

This invention provides a combination tool for performing either of the above procedures on side-bar ignition locks now in use. When the ignition lock's cylinder is to be immediately rotated to its ON position, the combination tool requires only a conventional wrench to accomplish the turning; this function of the combination tool of this invention corresponds to that of the lock-opening tool disclosed in my U.S. Pat. No. 5,402,661, issued Apr. 4, 1995. For removing side-bar ignition locks without damage, the novel combination tool of this invention functions as a drill guide, and may be provided as part of a kit which includes a matching drill bit, a side-bar pressure tool and a wafer pressure tool, all required to complete the undamaged lock's removal; this apparatus is similar to that disclosed in my U.S. Pat. No. 5,454,265, issued Oct. 3, 1995, with a different drill guide.

SUMMARY OF THE INVENTION

The novel combination tool of this invention has a plurality of projections expending horizontally therefrom, one shaped and positioned to engage the walls of the lock's keyway and at least one pair of diametrically opposite projections shaped to enter and fittingly engage a pair of correspondingly-shaped existing recesses in the lock's face. The rear end of the combination tool is hexagonally shaped, and a drill guide hole extends through the body of the tool.

When used as a lock-opening tool, the device is placed against the lock cylinder's face, a wrench applied to the hexagonal surface thereof, and pressure applied to the wrench is translated into torque exercised by the tool's projections against the contacted recess walls, forcing the lock to turn and thus to put the ignition in its ON position.

When used as a drill guide, the inventive tool is to be applied to the uncovered face of the lock, with the tool's projections serving to locate the guide in precise position so that when a drill bit is actuated through the tool's guide hole, an opening is created for access to the area directly above the lock's side-bar without damaging the lock or affecting its function. Thereafter, using a side-bar pressure tool in the access opening thus created, and a wafer pressure tool in the lock's keyway simultaneously therewith, the ignition lock may be opened and removed from its housing, a replacement key made, and the lock returned to its initial setting for continued use. Alternatively, the lock-opening, drill-guiding tool may be provided with removable projections for engaging the interior walls of the wing-nut lock cover, thus positioning the tool for access-hole-drilling therethrough.

Full details of the apparatus of this invention and its methods follow, disclosed and described with reference to the accompanying illustrative, but not limiting, drawings, wherein:

SHORT FIGURE DESCRIPTION OF DRAWINGS

FIG. 1 is a left top perspective view of an automotive side-bar ignition lock of the type now in use, with its wing-nut cover about to be pried off with a screwdriver:

FIG. 2 is a front end view of the lock assembly of FIG. 1 after the lock's wing-nut cover has been removed:

FIG. 3 is a right front perspective view of a preferred embodiment of the lock-opening, drill-guiding tool according to this invention:

FIG. 4 is a left side elevational view of the uncovered lock of FIGS. 1 and 2, with the tool of FIG. 3 mounted thereon and a wrench in position for applying lock-opening torque thereto;

FIG. 5 is a sectional view taken along line 5—5 of FIG. 2, but with the lock-opening, drill-guiding tool of FIG. 3 in operative position thereon, with the lock cylinder shown partially in elevation;

FIG. 6 is a right front perspective view of another preferred embodiment of the combination tool of this invention;

FIG. 7 is a right front perspective view of still another embodiment of a lock-opener, drill-guide;

FIG. 8 is a left front perspective partial view of the uncovered lock of FIG. 1, the combination tool of FIG. 3 in operative position thereon And a drill bit in position to bore an access opening therethrough:

FIG. 9 is a left front perspective view, partially broken away, of the lock of FIG. 8 after drilling, with a side-bar pressure tool in position to be inserted into the access opening created, and with a wafer pressure tool in position to be inserted into the lock's keyway;

FIG. 10 is a perspective view similar to FIG. 9, but with the two pressure tools inserted and the lock in position to be opened;

FIG. 11 is a left rear exploded perspective view of the parts of another embodiment o the lock-opening drill guide of this invention; and FIG. 12 is a left rear perspective view of the assembled lock-opening drill guide of FIG. 11 in operative position on the wing-nut cover of the lock, with a drill bit in position to bore an access opening.

DESCRIPTION OF THE PREFERRED EMBODIMENTS

The lock assembly generally designated 10 in the drawings of this application is one currently in use on Ford vehicles and is illustrative as an example on which the concepts of this invention may be practiced. As seen in FIG. 1, lock assembly 10 comprises lock housing 12 surrounding lock cylinder 14, on which lock cylinder cap 16, carrying wing-nut handle 18 extending therefrom, is mounted. Lock housing 12 carries latching assembly 20 with detent 22 projecting therefrom for securing lock assembly 10 in its vehicle mounting (not shown) when the ignition lock is in its OFF position. Also shown in FIG. 1 is screwdriver 24 being inserted into hollow wing-nut handle 18 of cylinder cap 16 to press against its inner walls in order to pry cap 16 off face 26 (FIG. 2) of cylinder 14.

FIG. 2 shows keyway 28 centrally disposed in lock cylinder face 26 and a pair of diametrically opposite U-shaped recesses 30 in face 26 defined by walls 32. Cylinder face 26 also has four quadrant-shaped recesses 34 evenly positioned around keyway 28.

The preferred embodiment 36 of combination lock-opener-drill-guide of this invention, as shown in FIG. 3, is a metal tool having its front portion D8 cylindrically shaped, while its rear portion 40 has a hexagonal outline. The front face 42 of front portion 38 has centrally disposed projection 44, shaded and sized complementarily to keyway 28 of lock 10, extending therefrom. In addition, a pair of diametrically opposite rectangular projections 46 are positioned and shaped for fitting engagement with lock face recesses 30 when combination tool 36 is placed in operative position on lock cylinder face 26, as shown in FIGS. 4 and 5. Drill guide hole 48 extends through tool 36 and is positioned therein so that an access opening drilled through it reaches the area directly above side-bar 52 (FIG. 5) without damaging the lock.

FIGS. 4 and 5 show uncapped lock 10 with device 36 in operative position on face 26 and paired projections 46 in contact with walls 32 of recesses 30; in FIG. 4, wrench 50 is in position on hexagonal portion 40 of tool 36 to apply torque, through projections 44 and 46 respectively, against keyway 28 and walls 32 of recesses 30, thereby forcing lock cylinder 14 to be turned and the vehicle's ignition to reach its ON position. FIG. 5 also shows side-bar 52 mounted in the cylindrical surface of lock cylinder 14, and lock wafers 54 in channels 56 on both sides thereof. Stepped shoulders 58 and 60 in lock housing 12, and corresponding diametric steps 62 and 64 in lock cylinder 14, make side-bar lock 10 highly resistant to being opened by probing with wires or thin-bladed instruments, thereby enhancing the value of the apparatus and methods of this invention as the most efficient viable alternative.

Embodiments **36*a* and 36*b* in FIGS. 6 and 7, respectively, are combination tools similar in all respects to tool 36 of FIGS. 3–5, having cylindrical front portions 38*a*, 38*b*, hexagonal rear portions 40*a*, 40*b*, front faces 42*a*, 42*b*, centrally positioned projections 44*a*, 44*b*, and drill guide holes 48*a*, 48*b*. However, diametrically opposite projections 46*a* and 46*b* differ in shape and position from projection 46, in that 46*a* and 46*b* are quadrant-shaped and are located so that when tool 36*a* or 36*b* is placed against lock surface 26, projections 46*a* or 46*b* extend into and fittingly engage a pair of diametrically opposite quadrant-shaped recesses 34 (see FIG. 2). Tools 36*a* and 36*b* perform precisely the same functions in the same way as tool 36, either as a lock-opener in FIG. 4, or as a drill guide to be seen in FIG. 8. It may be also noted that, if desired, more than one pair of diametrically opposite projections, for example, 46*a* and 46*b*, in addition to 46**, may be provided in the same combination tool.

When side-bar ignition lock tools 36, **36*a* or 36*b* are to be used not for quick lock-opening but for removal of undamaged lock 10 to make a key and return the lock to service, the procedure to be followed and the apparatus to be employed are illustrated in FIGS. 8–10. Thus, FIG. 8 has side-bar lock assembly 10, with combination tool 36 in position as a drill guide and drill bit 66, adjustably held in arbor 70, inserted through guide hole 48 in tool 36 to bore access opening 72, partly in lock housing 12 and partly in lock cylinder 14, shown after drilling in FIG. 9. FIG. 9 also illustrates generally L-shaped side-bar pressure tool 73, poised to be inserted into access opening 72, and wafer pressure tool 74, poised to be inserted into keyway 28 of ignition lock 10. Side-bar pressure tool 73 has elongated portion 75 thereof terminating at its free end forward portion with thin, slightly twisted blade 76 for contacting and exerting pressure against side-bar 52, right-angled handle portion 78 at its opposite end, and step 80 to act as a stop, preventing overpenetration of tool 73 and resultant damage to lock 10. Wafer tool 74 comprisies thin metal blade 82 with its free end 84 angularly cut at 86 and with its opposite end held in protective handle 88**.

Both side-bar tool 73 and wafer tool 74 are to be inserted into lock 10 at the same time, tool 74 being moved with an in-and-out motion to urge lock 10's wafers into alignment, while s steady inward pressure is exerted on side-bar tool 73; this action is to be continued until the position shown in FIG. 10 is achieved. Now lock cylinder 14 may be turned to the ON position, and tools 73 and 74 removed; now, detent 24 of latching mechanism 20 is released and ignition lock assembly 10 may be removed from its automotive mounting, a key conventionally made and lock 10, with wing-nut cylinder cap 16 snapped back into place, may be restored to its original operative location.

Combination tool **36*c* is illustrated in FIGS. 10 and 11; it is usable both as a lock-opener and a drill guide in the manner that tools 36, 36*a* and 36*b* are used as described above. However, tool 36*c* may be employed as a drill guide on lock 10 without removing wing-nut cap 16 from lock cylinder 14. The front portion 38*c* of tool 36*c* is rectangularly shaped, with the front face thereof carrying paired projections 46*c* and centrally disposed keyway-entering projection 44*c*, for tool 36*c* to carry out the functions of the combination tools previously described; the hexagonally-shaped rear portion of tool 36*c* for the lock-opening procedure. In addition, rear portion 40*c* is provided with a centrally positioned shallow rectangular groove 90 cut into and extending vertically through rear surface 92 of tool 36*c*, and with threaded opening 94 bored at the center of rear-facing surface 96 of groove 90. C-shaped element 98, of rectangular cross-section complementary in size to groove 90, comprises elongate central vertical portion 100 having bore opening 102 therein and top and bottom horizontal arms 104 extending from vertical portion 100. Screw 106 is provided to assemble element 98 with tool 36*c*, as shown in FIG. 12, where screw 106 is threaded into opening 94 of tool 36*c* through opening 102 of C-shaped element 98, which is held thereby flush in groove 90. FIG. 12 shows horizontal arms 104 of element 98 extending forwardly, inserted into and held firmly by the inner walls 108 of hollow wing-nut handle 18 of ignition lock cylinder cap 16, to permit accurate positioning of drill bit 66*c* safely to bore access opening 72*c* into ignition lock 10**.

The preferred embodiments of this invention have been disclosed as examples of the best modes now contemplated of practicing the invention's concepts. It will be understood by all skilled in the art that further embodiments, substitutions and modifications may be made without departing from these concepts, which are limited only by the scope of the ensuing claims, wherein;

What is claimed is:

1. In combination with automotive side-bar ignition locks having wafer elements therein and a plurality of matched recesses facing outwardly, dual-function apparatus for turning on, and for removing without damage, said side-bar ignition locks, which comprises:

a combination metal tool having a plurality of projections extending outwardly therefrom, said projections being positioned, sized and shaped complementarily to, and for fitting engagement with, said recesses in any automotive side-bar ignition lock to be serviced, said projections comprising:

one centrally disposed rectangular projection dimensioned to fit into said ignition lock's keyway; and at least one pair of diametrically opposite projections on said combination tool for fitting engagement in corresponding recesses in said ignition lock;

said combination tool having its rear portion shaped hexagonally to accept a wrench for turning said combination tool, applying torque to said projections and thus forcing said side-bar ignition lock to rotate to its ON position; and said combination tool also having a drill guide hole horizontally through its body, said guide being so located that, with said ignition lock in its OFF position and said combination tool operatively positioned thereon by said plurality of projections, a hole drilled through said guide hole into said lock will provide access to the area directly facing said lock's side-bar.

2. Dual-function apparatus as defined in claim 1, further comprising:

a drill bit fitting said guide hole in said combination tool, for drilling an access opening into said ignition lock;

a side-bar pressure tool for insertion into said access opening to apply inward pressure against said lock's side-bar; and a wafer pressure tool for insertion into the keyway of said lock to urge the alignment of said wafer elements while said side-bar pressure tool is simultaneously pressed through said access opening, whereby said side-bar is retracted and said ignition lock may be turned to its ON position and removed from its automotive mounting.

3. Dual-function apparatus as defined in claim 2, wherein said drill bit is adjustably held in an arbor to be gripped and driven by a conventional drill, said adjustable mounting permitting the selection of the length of a drilling stroke matching the required depth of said access opening in said ignition lock.

4. Dual-function apparatus as defined in claim 2, wherein said side-bar pressure tool comprises an L-shaped tool of rectangular cross-section with the handle thereof being the short side of the L substantially at a right angle to the longer side thereof, said longer side extending unchanged in dimensions for approximately one-third of its length from its handle, then being reduced in height for a middle third of its length forming a step therebetween, said step serving as a stop against the face of said ignition lock when said side-bar pressure tool is inserted in said access opening, a final third of said longer side being reduced in thickness to a blade slightly twisted out of the plane of the rest of said longer side, said final third blade being adapted to contact and apply inward pressure against said side-bar of said lock when said side-bar pressure tool is in operative position inserted through said access opening.

5. Dual-function apparatus as defined in claim 2, wherein said wafer pressure tool comprises a thin flat blade with one corner of its free operative end cut off at an angle, the opposite end of said blade being covered by a protective handle, said blade being of sufficient length to reach and apply pressure to urge all said wafer elements of said ignition lock into aligned open-lock position.

6. Combination tool as defined in claim 1, further comprising:

a centrally disposed rectangular vertical channel cut into the rear face of said combination tool;

a C-shaped element of rectangular cross-section dimensioned for fitting engagement in said vertical channel, the vertical elongate central portion of said C-shaped element to be assembled in and extend beyond said channel, the top and bottom horizontal portions of said C-shaped element extending forward beyond said plurality of projections, said horizontal portions being dimensioned to engage the inner walls of the wing-nut cylinder cap of said side-bar ignition lock and to hold said combination tool firmly in place as a guide to drill an access opening through said wing-nut cylinder cap and into said ignition lock; and means for centering and securing said C-shaped element in proper alignment in said vertical channel of said combination tool.

7. Method of turning the cylinder of a side-bar type automotive ignition lock having recesses in the face thereof, by using a tool having a plurality of projections extending forwardly therefrom, said projections comprising one centrally positioned rectangular projection dimensioned for fitting engagement in said keyway in the face of said lock and at least one pair of diametrically opposite projections shaped for fitting engagement with corresponding complementary recesses in the face of said lock, said tool having its rear portion hexagonally shaped, the method comprising the steps of:

a) prying off the wing-nut cylinder cap from the ignition lock's cylinder;

b) inserting the tool's projections into the lock's keyway and corresponding recesses, thus aligning the tool with the lock cylinder and engaging the walls of the keyway and recesses; and c) turning the tool by means of a wrench engaging and rotating the tool's rear hexagonally-shaped portion, so that the tool's projections exert torque against the recesses' walls, forcing the ignition lock cylinder to turn to its ON position.

8. Method of removing an automotive side-bar ignition lock without damage thereto, said ignition lock having a plurality of recesses, including its keyway and other recesses in its cylinder face as well as openings in the hollow wing-nut of said lock's cylinder cap, by using a combination tool having a plurality of projections extending outwardly therefrom, said projections including one centrally disposed rectangular projection sized and shaped for fitting engagement in said keyway of said lock, at least one pair of diametrically opposite projections for fitting engagement with corresponding complementary recesses in the face of said lock and optionally, one pair of diametrically opposite projections extending beyond said combination tool for fitting engagement with the inner walls of said hollow wing-nut, said combination tool having a drill guide hole therethrough for directing a drill into said lock to produce an access opening therein to the area directly adjacent to said lock's side-bar, the method comprising the steps of;

a) selecting a first step from the group consisting of:

prying of the wing-nut cylinder cap from the ignition lock's cylinder and leaving the wing-nut cylinder cap in place;

b) inserting the combination tool's projections into the lock's corresponding recesses, thus aligning the tool and its drill guide hole with the lock's cylinder;

c) inserting a drill bit, held adjustably in an arbor, into the guide hole of the combination tool and drilling an access opening in the ignition lock to a suitable depth;

d) removing both drill bit and combination tool;

e) simultaneously inserting a side-bar pressure tool into the drilled access opening and a wafer pressure tool into the lock's keyway, moving the wafer pressure tool therein in a reciprocating in-and-out motion to urge the lock's wafer elements into alignment while exerting steady inward pressure against the side-bar pressure tool, thereby causing the lock's side-bar to be retracted;

f) removing both side-bar and wafer pressure tools; and g) turning the lock cylinder to its ON position and removing the lock from its automotive mounting in a conventional manner.

9. The method as defined in claim 8, comprising the further steps of:

making a key for the ignition lock by conventional methods; and replacing the ignition lock with its wing-nut cylinder cap into its automotive mounting for continued use thereof.

* * * * *